US010378243B2

(12) United States Patent
Ke et al.

(10) Patent No.: US 10,378,243 B2
(45) Date of Patent: Aug. 13, 2019

(54) LOCK CAPABLE OF LOCKING MOVABLE DOOR

(71) Applicant: GUANGDONG ARCHIE HARDWARE CO., LTD., Guangdong (CN)

(72) Inventors: Zhijie Ke, Guangdong (CN); Peiquan Liang, Guangdong (CN)

(73) Assignee: GUANGDONG ARCHIE HARDWARE CO., LTD., Guangdong (CN)

( * ) Notice: Subject to any disclaimer, the term of this patent is extended or adjusted under 35 U.S.C. 154(b) by 0 days.

(21) Appl. No.: 16/151,322

(22) Filed: Oct. 3, 2018

(65) Prior Publication Data

US 2019/0032369 A1 Jan. 31, 2019

Related U.S. Application Data

(63) Continuation of application No. PCT/CN2017/106392, filed on Oct. 16, 2017.

(30) Foreign Application Priority Data

Jun. 5, 2017 (CN) ..... 2017 1 014970

(51) Int. Cl.
*E05B 57/00* (2006.01)
*E05B 9/00* (2006.01)
(Continued)

(52) U.S. Cl.
CPC ..... *E05B 57/00* (2013.01); *E05B 9/00* (2013.01); *E05B 15/10* (2013.01); *E05B 63/04* (2013.01);
(Continued)

(58) Field of Classification Search
CPC . E05B 57/00; E05B 9/00; E05B 15/10; E05B 63/042; E05B 63/146;
(Continued)

(56) References Cited

U.S. PATENT DOCUMENTS 4,643,005 A * 2/1987 Logas ..... E05C 9/026 292/20
5,722,704 A * 3/1998 Chaput ..... E05B 65/0811 292/26
(Continued)

FOREIGN PATENT DOCUMENTS

CN 203905655 10/2014
CN 206917448 1/2018

*Primary Examiner* — Suzanne L Barrett
(74) *Attorney, Agent, or Firm* — JCIPRNET

(57) ABSTRACT

A lock capable of locking a movable door includes a lock shell having opening parts, and hook tongues extending out of the opening parts. The lock further includes lock tongue support frames, lock tongue reset springs, left and right first guide grooves, and shifting blocks. The lock tongue support frames are movably disposed on the lock shell and combined with shaft pins. The hook tongues have lower shaft holes and rotatably sleeve the shaft pins via the lower shaft holes. Each lock tongue reset springs has one free end combined with the lock tongue support frames, and another one free end combined with the hook tongues. The left and right first guide grooves are symmetrically-arranged and correspond to the shaft pins. Two ends of the shaft pins respectively extending into the left and right first guide grooves. The shaft pins drive the hook tongues to move to be unhooked or locked when the lock tongue support frames move to drive the shaft pins to move along the left and right first guide grooves. Axial centers of the shifting blocks have center holes that allow shifting sheets to be inserted therein. The lock tongue support frames are able to move back and forth
(Continued)

to respond to rotation of shifting handles on the shifting blocks when the shifting blocks rotate.

10 Claims, 5 Drawing Sheets

(51) Int. Cl.
*E05B 15/10* (2006.01)
*E05B 63/04* (2006.01)
*E05B 63/14* (2006.01)
*E05B 65/08* (2006.01)

(52) U.S. Cl.
CPC ..... *E05B 63/042* (2013.01); *E05B 63/146* (2013.01); *E05B 65/0817* (2013.01); *E05B 65/0829* (2013.01); *E05B 65/0841* (2013.01); *E05B 2009/004* (2013.01)

(58) Field of Classification Search
CPC ..... E05B 65/0817; E05B 65/0829; E05B 65/0841; E05B 2009/004; E05C 9/00
USPC ..... 70/84; 292/97, 123, 196
See application file for complete search history.

(56) References Cited

U.S. PATENT DOCUMENTS 5,820,170 A * 10/1998 Clancy ..... E05B 65/0858 292/26
6,264,252 B1 7/2001 Clancy
7,040,671 B2 * 5/2006 Su ..... E05B 63/0013 292/116
7,418,845 B2 * 9/2008 Timothy ..... E05B 63/185 292/196
7,559,584 B2 * 7/2009 Rebel ..... E05B 63/0056 292/25
8,827,324 B2 9/2014 Furgiuele
2006/0071478 A1 * 4/2006 Denys ..... E05B 63/12 292/26
2009/0134634 A1 * 5/2009 Atkinson ..... E05B 63/06 292/26

* cited by examiner

LOCK CAPABLE OF LOCKING MOVABLE DOOR

CROSS-REFERENCE TO RELATED APPLICATION

This is a continuation of International Application No. PCT/CN2017/106392, filed on Oct. 16, 2017, which claims the priority benefits of China Application No. 201710414970.X, filed on Jun. 5, 2017. The entirety of each of the above-mentioned patent applications is hereby incorporated by reference herein and made a part of this specification

FIELD OF THE INVENTION

The invention relates to a lock and in particular to a lock for a movable door. The lock for the movable door is provided with a pair of relatively-moving hook tongues hooking a locator on a door leaf or a door frame at an opposite side, so as to lock the door leaf.

BACKGROUND OF THE INVENTION

For an existing lock for a movable door, hook tongues in a prior art are enabled to rotate around a rotating shaft under a direct drive of a connecting rod. Rotation angle of the hook tongues is decided by a moving distance of the connecting rod, for example, as disclosed by U.S. Pat. Nos. 6,264,252B1 and 8,827,324B2, and Chinese patent No. 201420278913.5. When the door leaf has been unlocked and the hook tongues of the lock are exposed, movement of the connecting rod is generally controlled and locked by a relevant mechanism such as an additional button, or the hook tongues are controlled not to extend out of a lock shell, so that the hook tongues are prevented from impacting against passing pedestrians. However, when the button doesn't work or other reasons that make the pair of hook tongues extend out, it is very easy to cause injury to people and result in safety accidents.

SUMMARY OF THE INVENTION

In order to further improve safety of the lock for the movable door, the invention provides a lock capable of locking a movable door, including a lock shell and hook tongues capable of performing locking work on a door leaf. The hook tongues include hook tongue upper parts and hook tongue lower parts. The hook tongue upper parts are hook-shaped. The lock shell includes a front shell and left and right shells located at two sides of the front shell. The front shell is provided with opening parts corresponding to the hook tongues so that the hook tongues located in the lock shell are capable of extending out of the opening parts. The lock further includes lock tongue support frames, lock tongue reset springs, left and right first guide grooves, and shifting blocks. The lock tongue support frames, movably arranged in the lock shell. The lock tongue support frames are combined with first shaft pins, the hook tongue lower parts of the hook tongues having lower shaft holes being formed in the hook tongue lower parts of the hook tongues. The hook tongues rotatably sleeve the first shaft pins via the lower shaft holes. Each of the lock tongue reset springs is provided with two free ends, one of the free ends is combined with the lock tongue support frames, the other one of the free ends is combined with the hook tongues so that the hook tongues are capable of automatically resetting from a head-lowering state to a head-raising standing state under an elastic drive of the lock tongue reset springs, and conversely, the hook tongues may be pressed to the head-lowering state from a head-raising state when being pressed by an external force. The left and right first guide grooves are symmetrically arranged on the left and right shells and correspond to the first shaft pins. Two ends of each of the first shaft pins respectively extend into the left and right first guide grooves. The first shaft pins drive the hook tongues to move to be unhooked or locked when the lock tongue support frames move to drive the first shaft pins to move along the left and right first guide grooves. The shifting blocks are rotatably arranged on the left and right shells. Center holes capable of inserting shifting sheets are formed in axial centers of the shifting blocks. The shifting blocks are provided with shifting handles. The lock tongue support frames are capable of moving back and forth to respond to the rotation of the shifting handles on the shifting blocks during rotation of the shifting blocks.

The head-raising standing state means that the hook tongues are in a direction approximately perpendicular to the front shell, and the hook tongue upper parts extend out of the front shell, so that it is convenient to perform locking work. The head-lowering state means that the hook tongues rotate to be approximately parallel to the front shell and are accommodated into the front shell.

The first guide grooves are devices mainly used for guiding the hook tongues to move in an unhooking or locking direction, may be arranged in a direction parallel to the front shell, and may be arranged at a slighting inclined angle or a direction of an arc-shaped track, as long as the hook tongues are to be unhooked or locked.

Each shifting sheet is a driving part connected to a lock lining or a rotary knob, and is generally flake-shaped or rectangular. When the shifting sheets are inserted into the center holes from the outer part of the lock, the shifting sheets may rotate while the lock lining or the rotary knob is rotated, and therefore, the shifting blocks are driven to rotate.

The lock tongue support frames may move back and forth to respond to the rotation of the shifting handles on the shifting blocks, which means that the lock tongue support frame may move back and forth with the rotation of the shifting handles. The lock tongue support frame may be in a direct linkage connection with the shifting handles, or an indirect linkage connection that may be realized via mechanisms such as connecting rods to be mentioned below.

According to the abovementioned technical scheme, compared with the prior arts, it may be found that due to the arrangement of the first guide grooves, the hook tongues are enabled to move towards an inner side (namely the middle direction of the lock) or an outer side in a direction determined by the first guide grooves, so that the hook ends of the hook tongues may be locked on a locator on the door leaf or a door frame at an opposite side (namely locked) or unlocked (namely unhooked). The hook tongues are rotatably arranged on the first shaft pins on the lock tongue support frames and are reset via the lock tongue reset springs. The hook tongues are pressed to the head-lowering state to rotate into the lock shell by utilizing the characteristic that the hook tongues are capable of rotating on the first shaft pins when being pressed by impact and the like, so that the safety of a lock body is further improved.

If the hook ends of the hook tongues are set to face to the inner side, the hook ends are locked when moving towards the inner side and are unlocked when moving towards the outer side; conversely, if the hook ends are set to face to the outer side, the hook ends are unlocked when moving towards the inner side and are locked when moving towards the outer side. Generally, the first solution is adopted.

A further technical solution may also be that the lock further includes locating parts arranged on the lock tongue support frames. The hook tongue lower parts are further provided with shoulder parts matched with the locating parts. The locating parts are suitable for matching with the shoulder parts to limit the head-raising standing states of the hook tongues when the lock tongue reset springs drive the hook tongues to rotate to be reset to the head-raising state from the head-lowering state on the first shaft pins.

The head-raising standing states mean positions where the hook tongues are located when raising heads, the locating parts and the shoulder parts are matched to ensure that the hook tongues are incapable of further rotating limitlessly when raising the heads, but are limited on a certain proper standing position, so that it is convenient to lock the hook tongues.

A further technical solution may also be that the shoulder parts are shaped like slopes. The locating parts are provided with regulating screws, tops of the regulating screws are further provided with slopes fitted with the shoulder parts. The shoulder parts press against the regulating screws when the hook tongues are in the head-raising standing state. The standing angles of the hook tongues may be correspondingly and slightly adjusted when the heights of the regulating screws are regulated.

A further technical solution may also be that connecting rods are arranged between the shifting handles and the lock tongue support frames and are used for realizing response of the lock tongue support frames to the rotation of the shifting handles. The tail ends of the connecting rods are rotatably connected to the shifting handles, the head ends of the connecting rods are hinged with the head ends of the lock tongue support frames by second shaft pins. Left and right second guide grooves corresponding to the second shaft pins are respectively formed in the left and right shells, and two ends of the second shaft pins respectively extend into the left and right second guide grooves and are capable of moving along groove tracks limited by the second guide grooves.

A further technical solution may also be that crank arms capable of converting directions and transition connecting pieces are further arranged between the shifting handles and the lock tongue support frames. The crank arms are rotatably arranged between the left and right shells. Center pin shafts for locating the crank arms are fixedly arranged on the left and right shells, so that the crank arms are capable of rotating around the center pin shafts. An end-to-end connection relationship is that the head ends of the lock tongue support frames are connected to the head ends of the connecting rods, the tail ends of the connecting rods are connected to the head ends of the crank arms, the tail ends of the crank arms are connected to the head ends of the transition connecting pieces, and the tail ends of the transition connecting pieces are connected to the shifting handles.

A further technical solution may also be that the lock tongue reset springs sleeve the first shaft pins and are located in accommodating spaces below the hook tongues.

A further technical solution may also be that the lock tongue support frames are shaped as frames and are provided with left and right frames and connecting blocks connected between the tail ends of the left and right frames. The hook tongues sleeve the first shaft pins via the lower shaft holes and are located between the left and right frames, wherein the connecting blocks may be dependent from the locating parts or be combined with the locating parts.

A further technical solution may also be that the lock further includes left and right first inclined grooves symmetrically arranged on the left and right shells and smoothly linked at the tail ends of the left and right first guide grooves. The left and right first inclined grooves extend in a direction inclined to the front shell; the left and right first inclined grooves are suitable for not only guiding the lower lock tongue support frame to sink, but also guiding the lower hook tongue to synchronously sink into the lock shell when the first shaft pins are descended along the first inclined grooves, and conversely, the left and right first inclined grooves are suitable for guiding the lower hook tongue to extend out of the opening parts. The left and right first inclined grooves extend in a direction inclined to the front shell, which means that the left and right first inclined grooves extend in a direction forming a certain included angle with a horizontal direction, namely in two directions with the first direction being inclined to the outer side and the second direction being inclined to the inner side. The setting of the inclination direction is mainly related to the way of withdrawing the hook tongues, the first inclined grooves are linked to the tail ends of the outer sides of the first guide grooves and extend in a direction inclined to the outer side when the hook tongues are withdrawn into the lock shell while the first inclined grooves move towards the outer side; and the first inclined grooves are linked to the tail ends of the inner sides of the first guide grooves and extend in a direction inclined to the inner side when the hook tongues are withdrawn into the lock shell while the first inclined grooves move towards the inner side.

A further technical solution may also be that side edges of the shifting blocks are further provided with limiting shafts located on the left and right shells. The limiting shafts are matched with the shifting handles and are used for limiting the rotation angles of the shifting blocks.

A further technical solution may also be that the lock further includes a pair of hook tongues arranged up and down and a pair of shifting blocks. The hook ends of the pair of hook tongues face to opposite directions. The pair of hook tongues is capable of relatively moving to be close to or away from each other under the drive of any one of the pair of shifting blocks.

Due to the characteristics and advantages, the lock may be applied to the lock for the movable door.

DESCRIPTION OF THE EMBODIMENTS

The description of the embodiment according to the invention is further described below in combination with FIG. 1 to FIG. 6.

Figure 1:
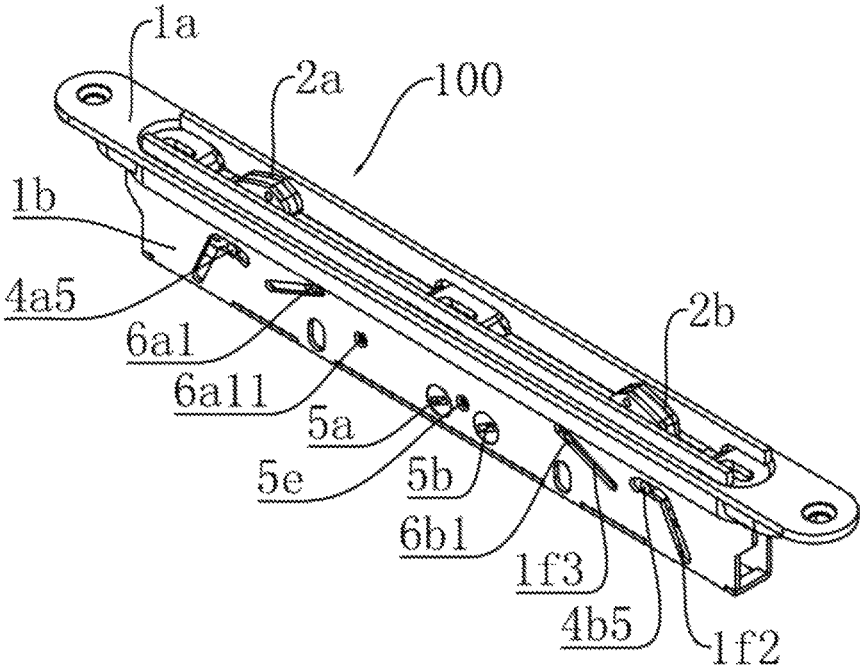
FIG. 1 is a perspective schematic diagram of a lock capable of locking a movable door according to an embodiment of the invention.
Figure 2:
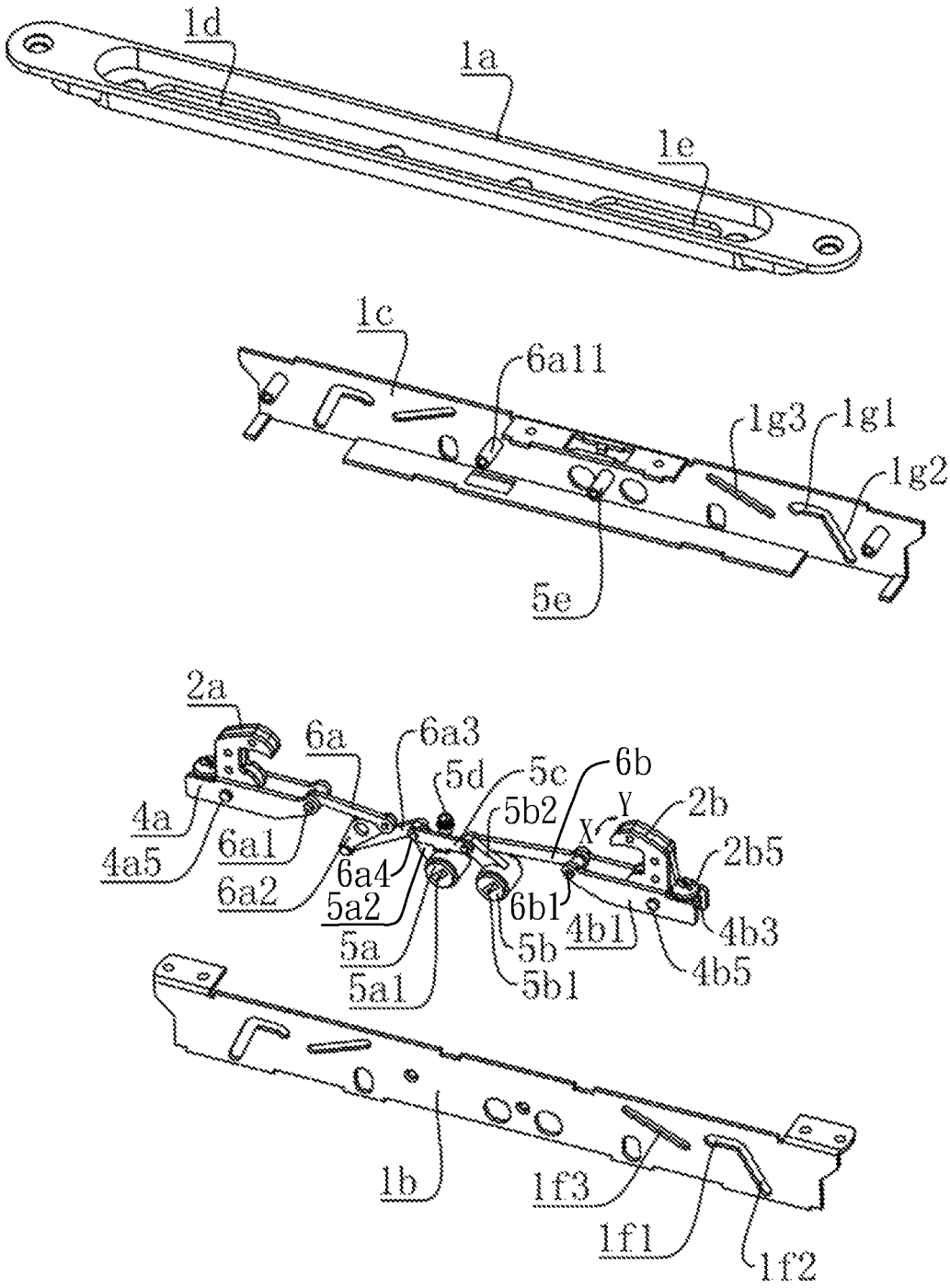
FIG. 2 is an exploded schematic diagram of the lock capable of locking the movable door according to the embodiment of the invention, wherein a lower hook tongue 2*b* is capable of rotating in an X-Y direction, namely the lower hook tongue 2*b* is capable of rotating from a head-lowering state to a head-raising standing state under an elastic drive of a lower lock tongue reset spring 3*b* (shown in FIG. 3), and in contrary, the lower hook tongue 2*b* is capable of rotating from the head-raising standing state to the head-lowering state when being pressed by an external force so as to be embedded into a lock shell.

As shown in FIG. 1 and FIG. 2, a lock 100 adapted to lock a movable door includes a lock shell and a pair of driving modules, which are independent from but co-movable with each other, and are disposed in the lock shell, namely an upper driving module and a lower driving module. The upper driving module is connected to the lower driving module by an interconnecting piece 5*c* to form a linkage relationship. The upper driving module and the lower driving module have basically symmetric structures, for example, each of the upper driving module and the lower driving module includes a hook tongue, a lock tongue support frame, a connecting rod and the like. However, a transmission structure is slightly adjusted in the upper driving module in order to achieve relative movement of the two hook tongues being close to or away from each other. The similarities and differences between the upper driving module and the lower driving module are described below in combination with the accompanying drawings.

As shown in FIG. 1 and FIG. 2, the lock shell includes a front shell 1*a* which faces outwardly, and left and right shells 1*b*, 1*c* which located at two sides of the front shell 1*a* so that a cavity for accommodating other components is defined. The front shell 1*a* is provided with opening parts 1*d*, 1*e* corresponding to upper and lower hook tongues 2*a*, 2*b*, so that the upper and lower hook tongues 2*a*, 2*b* located in the lock shell are capable of extending out of the opening parts 1*d*, 1 *e*.

As shown in FIG. 1 and FIG. 2, the upper driving module and the lower driving module respectively includes an upper hook tongue 2*a* and a lower hook tongue 2*b* capable of locking a door leaf. The pair of upper and lower hook tongues 2*a*, 2*b* and the corresponding opening parts 1*d*, 1*e* are respectively arranged at upper and lower ends of the lock 100, and are used for symmetrically hooking a locator (not shown in the figures) located on the door leaf or a door frame at an opposite side. The upper and lower hook tongues 2*a*, 2*b* have substantially identical structures. Driving structures for respectively driving movements of the upper and lower hook tongues 2*a*, 2*b* are also approximately same. A specific structure of the embodiment is mainly described below by taking the lower hook tongue 2*b* in the lower driving module and relevant driving devices forming a direct linkage relationship with the lower hook tongue 2*b* as examples.

Figure 3:
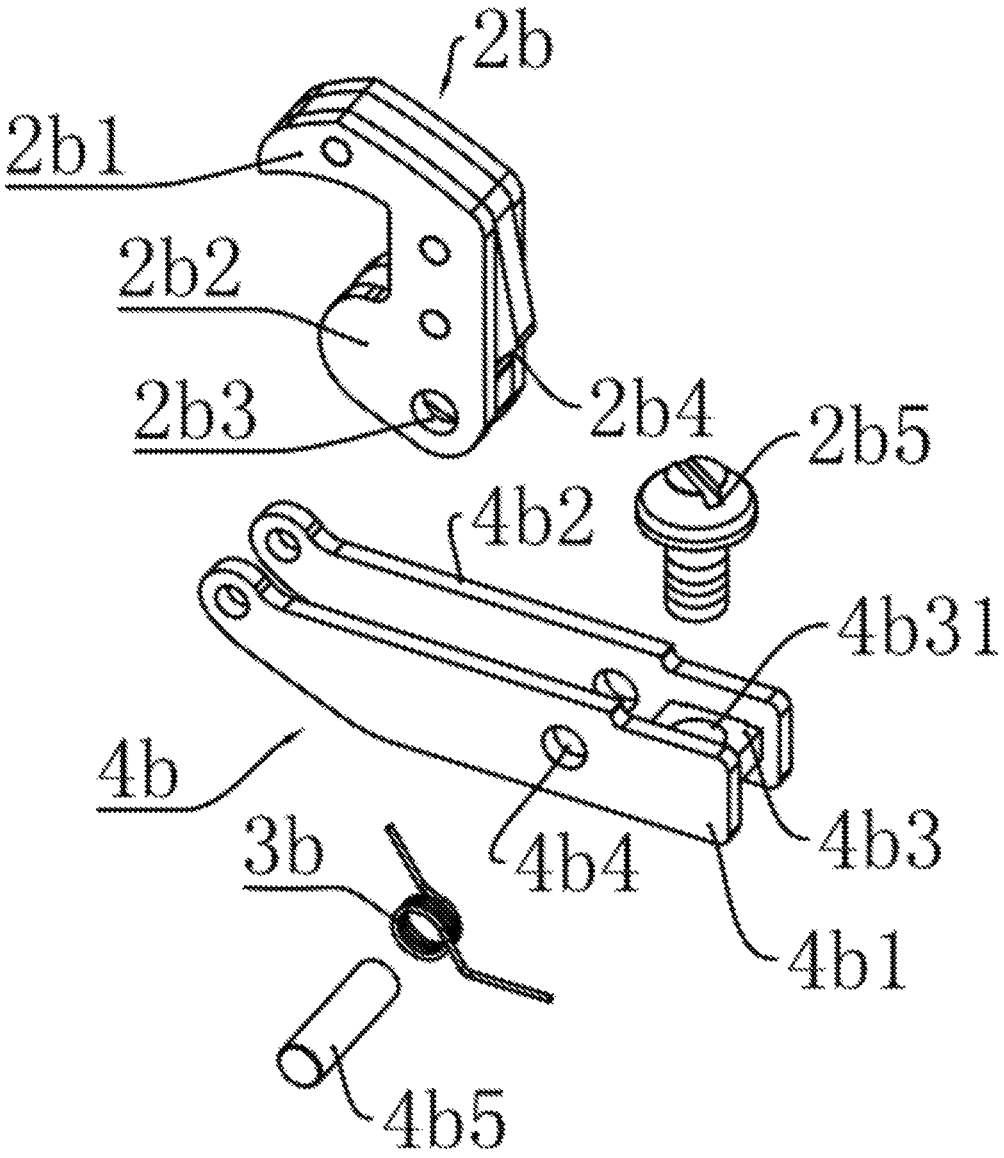
FIG. 3 is an exploded schematic diagram of a hook tongue and a lock tongue support frame of the lock capable of locking the movable door according to the embodiment of the invention.
Figure 4:
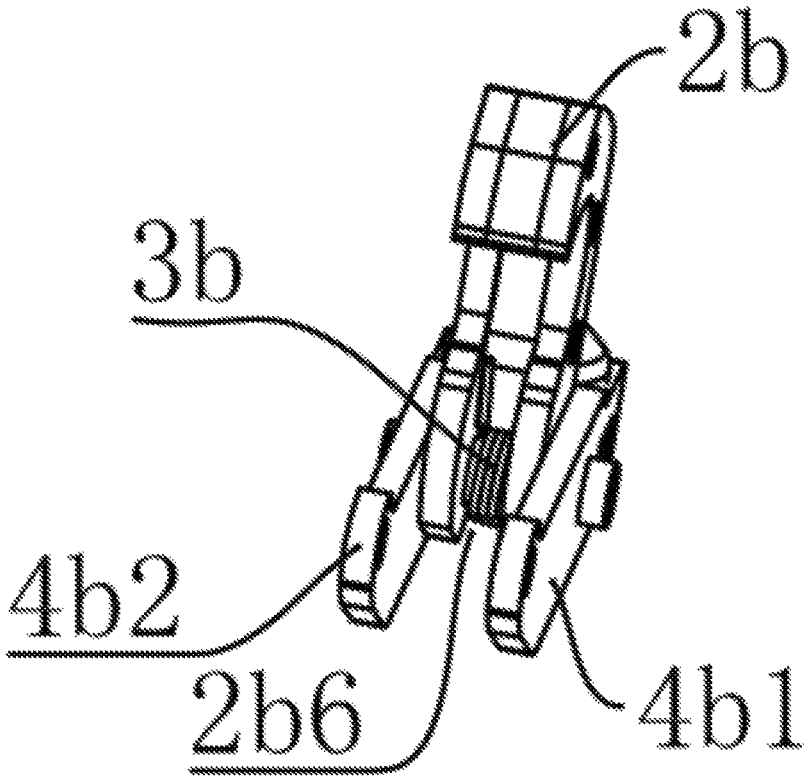
FIG. 4 is an assembled schematic diagram of the hook tongue and the lock tongue support frame of the lock capable of locking the movable door according to the embodiment of the invention.

As shown in FIG. 3 and FIG. 4, the lower hook tongue 2*b* includes a hook tongue upper part 2*b*1 and a hook tongue lower part 2*b*2. The hook tongue upper part 2*b*1 is hook-shaped so as to be a hook end of the lower hook tongue 2*b*. The hook end faces to a middle of the lock, so that the hook tongue upper part 2*b*1 is capable of hooking the locator on the door leaf or the door frame at the opposite side when the lower hook tongue 2*b* moves toward an inner side of the lock, and when the lower hook tongue 2*b* moves in a converse manner, the hook tongue upper part 2*b*1 is unhooked.

The hook tongue lower part 2*b*2 is provided with a lower shaft hole 2*b*3 and a shoulder part 2*b*4 which is shaped as a slope. A left-right spacing distance exists between the lower shaft hole 2*b*3 and the shoulder part 2*b*4. The hook tongue lower part 2*b*2 is formed with an accommodating space 2*b*6 inside thereof for accommodating a lower lock tongue reset spring 3*b*. Similarly, a lower part of the upper hook tongue 2*a* is also provided with an accommodating space, and an upper lock tongue reset spring that is used for driving the upper hook tongue 2*a* to reset.

The upper driving module and the lower driving module further respectively includes an upper lock tongue support frame 4*a* and a lower lock tongue support frame 4*b*. The upper and lower lock tongue support frames 4*a*, 4*b* are movably disposed in the lock shell and are used for respectively supporting the upper and lower hook tongues. 2*a*, 2*b* the upper and lower lock tongue support frames 4*a*, 4*b* have substantially same structures, so that the lock tongue support frame 4*b* in the lower driving module (b) is mainly described in the following description. As shown in FIG. 3 and FIG. 4, the lower lock tongue support frame 4*b* is shaped as a frame and is provided with left and right frames 4*b*1, 4*b*2 and a connecting block 4*b*3 that is connected between the left and right frames. The connecting block 4*b*3 is located at a tail end or at a position slightly close to a middle part of the lower lock tongue support frame 4*b*. In this embodiment, the connecting block 4*b*3 is configured as a positioning part 4*b*3 that corresponds with the shoulder part 2*b*4 to limit the lower hook tongue 2*b* to rotate to a head-raising position. A support frame hole 4*b*4 passing through the upper and lower lock tongue support frames 4*a*, 4*b* is formed at a position where it is spaced apart from the connecting block 4*b*3 with a certain spatial distance, and located at the tail end of the lower lock tongue support frame 4*b*. A first shaft pin 4*b*5 engages the support frame hole 4*b*4, and has two ends that respectively extend to the left and right shells 1*b*, 1*c*.

Figure 5:
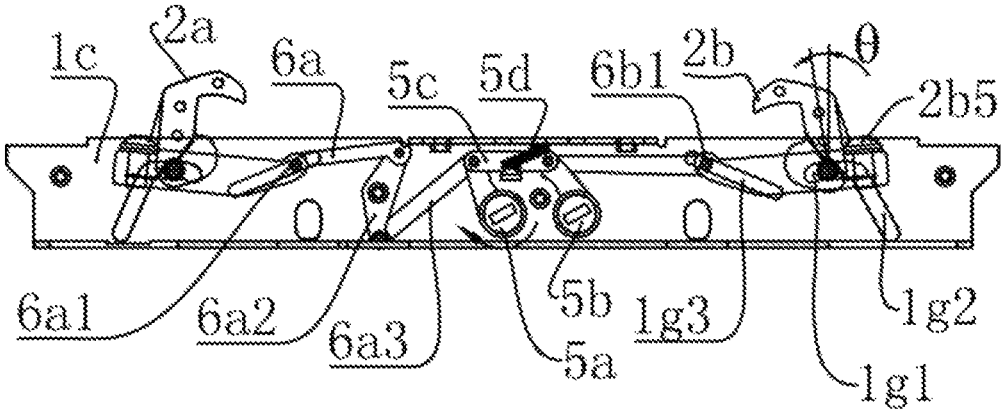
FIG. 5 is a schematic diagram when the hook tongue of the lock capable of locking the movable door according to the embodiment of the invention is in an extending state, wherein an internal state of a left shell 1*b* is omitted, and the hook tongue 2*b* is slightly adjusted by a regulating screw 2*b*5 so as to be inclined with an angle (θ).

The lower hook tongue 2*b* sleeves the first shaft pin 4*b*5 via the lower shaft hole 2*b*3 and is located between the left and right frames 4*b*1, 4*b*2 so as to be capable of rotating relative to the lower lock tongue support frame 4*b*. The lower lock tongue reset spring 3*b* is located in the accommodating space 2*b*6, sleeves the first shaft pin 4*b*5 and is provided with two free ends, wherein one of the free ends is combined with the lower hook tongue 2*b*, and the other one of the free ends is combined with the connecting block 4*b*3. As shown in FIG. 2 and FIG. 5, the lower hook tongue 2*b* may be kept in a head-raising state all the time due to an elastic direction of the lower lock tongue reset spring 3*b*. Even if the lower hook tongue 2*b* is pressed by an external force to rotate around the first shaft pin 4*b*5 in an anti-clockwise direction (an X direction as shown in FIG. 2), and to a head-lowering state that is to be embedded between the left and right frames (4*b*1, 4*b*2), the lower hook tongue 2*b* is immediately and automatically reset from the head-lowering state to the head-raising state in a clockwise direction (a Y direction) under the elastic drive of the lower lock tongue reset spring 3*b* after being released. Conversely, it may be understood that although the lower lock tongue reset spring 3*b* is in the head-raising state, the lower hook tongue 2*b* may be pressed to the head-lowering state and embedded into the lock shell when being hard pressed.

The upper and lower lock tongue support frames 4*a*, 4*b* capable of moving in this embodiment are not provided in other existing prior arts. The hook tongues in the prior arts are enabled to rotate around a rotating shaft under a direct drive of connecting rods. Rotation angles of the hook tongues are controlled by the connecting rods, for example, as disclosed by U.S. Pat. No. 6,264,252B1. When the door leaf has been unlocked and the hook tongues of the lock are exposed, the movement of the connecting rods is generally controlled and locked by a relevant mechanism such as an additional button, or the hook tongues are controlled not to extend out of the lock shell, so that the hook tongues are prevented from impacting against passing pedestrians, for example, as disclosed by U.S. Pat. No. 8,827,324B2. According to the upper and lower hook tongues 2*a*, 2*b* freely rotating around the first shaft pin 4*b*5 in the embodiment, even if impact against the extended upper hook tongue 2*a* or lower hook tongue 2*b* happens when the door leaf is passed by, the upper hook tongue 2*a* or the lower hook tongue 2*b* may also be compressed into the lock shell due to an external impact force, so that injury can be avoided.

The connecting block 4*b*3 (the locating part 4*b*3) which has been mentioned above is suitable for the solution that the locating part 4*b*3 is matched with the shoulder part 2*b*4 to limit the lower hook tongue 2*b* to rotate to a head-raising standing state. When the lower lock tongue reset spring 3*b* drives the lower hook tongue 2*b* to rotate to be reset to a head-raising standing state from a head-lowering state on the first shaft pin 4*b*5, the locating part 4*b*3 is matched with the shoulder part 2*b*4 to limit the position of the lower hook tongue 2*b* raising the head. A further solution may also be that the shoulder part 2*b*4 is shaped as a slope. The locating part 4*b*3 is provided with a screw hole 4*b*31 and a regulating screw 2*b*5 which may be screwed into the screw hole 4*b*31. A top of the regulating screw 2*b*5 is further provided with a slope fitted with the shoulder part 2*b*4. The shoulder part 2*b*4 presses against the regulating screw 2*b*5 when the lower hook tongue 2*b* stands, in this way, as shown in FIG. 5, the standing angle (0) of the lower hook tongue 2*b* may be correspondingly and slightly adjusted when a height of the regulating screw 2*b*5 is regulated, so that the lower hook tongue 2*b* is enabled to be at an optimal angle that is suitable for locking.

As shown in FIG. 1, FIG. 2, FIG. 5 and FIG. 6, the left and right shells 1*b*, 1*c* are further provided with left and right first guide grooves 1*f*1, 1*g*1. The left and right first guide grooves 1*f*1, 1*g*1 are symmetrically arranged on and correspond to the first shaft pin 4*b*5. Two ends of the first shaft pin 4*b*5 respectively extend into the left and right first guide grooves 1*f*1, 1*g*1 and are capable of moving along groove tracks defined by the first guide grooves 1*f*1, 1*g*1. The left and right first guide grooves 1*f*1, 1*g*1 are parallel to the font shell 1*a*. Thus, during movement, the lower lock tongue support frame 4*b* is capable of moving under the guide of the first shaft pin 4*b*5 and the left and right first guide grooves 1*f*1, 1*g*1 so as to drive the lower hook tongue 2*b* to also move towards the outer side or the inner side, so that the hook tongue upper part 2*b*1 is capable of hooking the locator on the door leaf or the door frame at the opposite side to lock the lower hook tongue 2*b* when the lower hook tongue 2*b* moves towards the middle (the inner side) of the lock, and conversely, the hook tongue upper part 2*b*1 may be unhooked.

Figure 6:
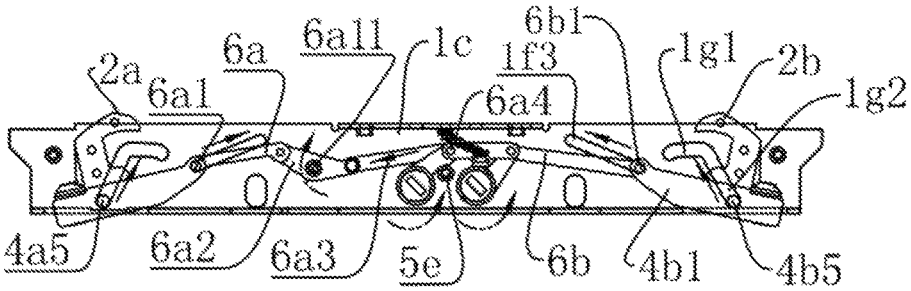
FIG. 6 is a schematic diagram when a pair of hook tongues 2*a*, 2*b* of the lock capable of locking the movable door according to the embodiment of the invention is in a withdrawing state, wherein the internal state of the left shell 1*b* is omitted.

Further, the left and right shells 1*b*, 1*c* are further provided with left and right first inclined grooves 1*f*2, 1*g*2 which are smoothly linked at the tail ends of the outer sides of the left and right first guide grooves 1*f*1, 1*g*1, and extend to the outer side at an angle inclined to the front shell 1*a*. The left and right first guide grooves 1*f*1, 1*g*1 are suitable for not only guiding the tail end of the lower lock tongue support frame 4*b* to sink, but also guiding the lower hook tongue 2*b* to synchronously sink into the lock shell while moving towards the outer side, when the first shaft pin 4*b*5 is descended along the first inclined grooves 1*f*2, 1*g*2, and conversely, the left and right first guide grooves 1*f*1, 1*g*1 are suitable for guiding the lower hook tongue 2*b* to extend out of the opening part 1*e*. Therefore, it may be found that, when the lower hook tongue 2*b* moves towards the outer side of the lock by taking the position as shown in FIG. 5 as a starting point, the lower hook tongue 2*b* leaves from the locator on the door leaf or the door frame at the opposite side under the guide of the left and right first guide grooves 1*f*1, 1*g*1 so as to achieve unhooked movement beforehand, and then is gradually descended under the guide of the first inclined grooves 1*f*2, 1*g*2 so as to be accommodated into the lock shell as shown in FIG. 6, and conversely, a locking function is achieved.

A movement track of a fourth shaft pin 4*a*5 for connecting the upper lock tongue support frame 4*a* and the upper hook tongue 2*a* and the structure of the guide grooves are basically symmetric with the abovementioned structure.

As shown in FIG. 1, FIG. 2, FIG. 5 and FIG. 6, the upper driving module and the lower driving module respectively includes an upper shifting block 5*a* and a lower shifting block 5*b*. The upper shifting block 5*a* and the lower shifting block 5*b* are arranged in an up and down manner. The pair of upper and lower shifting blocks 5*a*, 5*b* are rotatably arranged on the left and right shells 1*b*, 1*c* and are located in the lock shell. Center holes 5*a*1, 5*b*1 capable of inserting external shifting sheets are respectively formed in axial centers of the upper and lower shifting blocks 5*a*, 5*b*. The upper and lower shifting blocks 5*a*, 5*b* are also respectively provided with upper and lower shifting handles 5*a*2, 5*b*2 which are capable of respectively driving the upper and lower lock tongue support frames 4*a*, 4*b* to also move back and forth when rotating. The upper and lower lock tongue support frames 4*a*, 4*b* are capable of respectively moving back and forth to respond to the rotation of the shifting handles 5*a*2, 5*b*2 on the shifting blocks 5*a*, 5*b*. Moreover, the upper and lower lock tongue support frames 4*a*, 4*b* may be simultaneously driven to move closely or away from each other when the upper shifting block 5*a* or the lower shifting block 5*b* rotates. A driving structure of the lower shifting block 5*b* in the lower driving module is emphasized below.

A first connecting rod 6*b* is disposed between the lower shifting handle 5*b*2 of the lower shifting block 5*b* and the lower lock tongue support frame 4*b*. The lower shifting handle 5*b*2, the lower lock tongue support frame 4*b* and the first connecting rod 6*b* are hinged together. The first connecting rod 6*b* moves back and forth to realize the response of the lower lock tongue support frame 4*b* to the rotation of the shifting handle 5*b*2, wherein a head end of the first connecting rod 6*b* is hinged with a head end of the lower lock tongue support frame 4*b* by a second shaft pin 6*b*1. The left and right shells 1*b*, 1*c* are respectively provided with left and right second guide grooves 1*f*3, 1*g*3 corresponding to the second shaft pin 6*b*1. Two ends of the second shaft pin 6*b*1 respectively extend into the left and right second guide grooves 1*f*3, 1*g*3 and are capable of moving along groove tracks limited by the second guide grooves 1*f*3, 1*g*3. The left and right second guide grooves 1*f*3, 1*g*3 extend to the outer side at an inclined angle which may be the same as that of the left and right first inclined grooves 1f2, 1g2 or slightly different from that of the left and right first inclined grooves 1f2, 1g2. The left and right second guide grooves 1f3, 1g3 are used for guiding the movement of the second shaft pin 6b1. The head end of the lower lock tongue support frame 4b is also synchronously guided to sink when the second shaft pin 6b1 is descended along the second guide grooves 1f3, 1g3. In other embodiments, the left and right second guide grooves 113, 1g3 may also be horizontally arranged as the left and right first guide grooves do 1f1, 1g1.

Further, the lower shifting handle 5b2 is hinged with the tail end of the first connecting rod 6b by a third shaft pin 6b2 which is located in the lock shell, but is floated and is not connected with the left and right shells 1b, 1c.

Further, the lock further comprises a lock lining or a rotary knob (not shown in the figure) adapted to the lower shifting block 5b. A square iron (the shifting sheet) connected to the lock lining or the rotary knob may be inserted to the center hole 5b1 formed in the axial center of the lower shifting block 5b, so that the lock may be unlocked/locked via the lock lining or the rotary knob.

According to the abovementioned, as shown in FIG. 5, when the door is unlocked by setting the lower shifting block 5b to rotate in a clockwise direction according to a usual habit, the lower shifting handle 5b2 also rotates in the clockwise direction and further pushes the first connecting rod 6b to move towards the outer side, and the first connecting rod 6b moving towards the outer side pushes the lower lock tongue support frame 4b and the lower hook tongue 2b to move towards the outer side, so that the door is unlocked. In a last stage that the lower lock tongue support frame 4b moves towards the outer side, as shown in FIG. 6, the lower lock tongue support frame 4b sinks to drive the lower hook tongue 2b to sink to be withdrawn into the lock shell. Conversely, the lower hook tongue 2b moves towards the inner side, so that the door leaf is locked.

In order to achieve the aim that any one of the shifting blocks is capable of driving the upper and lower hook tongues 2a, 2b to move closely or away from each other when the upper shifting block 5a or the lower shifting block 5b rotates, an interconnecting piece 5c is connected between the pair of upper and lower shifting handles 5a2, 5b2. Furthermore, when any one of the upper and lower shifting handles 5a2, 5b2 rotates in the clockwise direction or the anticlockwise direction. The other shifting handle may also be driven to synchronously rotate. In addition, a crank arm 6a2 capable of converting directions and a transition connecting piece 6a3 are further arranged between the upper shifting handle 5a2 and the upper lock tongue support frame 4a in addition to the second connecting rod 6a. The crank arm 6a2 is rotatably arranged between the left and right shells 1b, 1c, and a center pin shaft 6a21 for locating the crank arm 6a2 is fixedly arranged on the left and right shells 1b, 1c, namely the crank arm 6a2 is capable of rotating around the center pin shaft 6a21. An end-to-end connection relationship is that the head end of the upper lock tongue support frame 4a is connected to the head end of the second connecting rod 6a, the tail end of the second connecting rod 6a is connected to the head end of the crank arm 6a2, the tail end of the crank arm 6a2 is connected to the head end of the transition connecting piece 6a3, and the tail end of the transition connecting piece 6a3 is connected to the upper shifting handle 5a2. The upper lock tongue support frame 4a is hinged with the head end of the second connecting rod 6a via a fifth shaft pin 6a1, the left and right shells 1b, 1c are respectively provided with guide grooves corresponding to the fifth shaft pin 6a1. The structures of the guide grooves corresponding to the fifth shaft pin 6a1 are the same as those of the left and right second guide grooves 1f3, 1g3. Further, the tail end of the transition connecting piece 6a3 is hinged with the upper shifting handle 5a2 by a sixth shaft pin 6a4. The sixth shaft pin 6a4 is also floated like the third shaft pin 6b2 does, and is located in the lock shell, but is not connected with the left and right shells 1b, 1c.

Thus, when the upper shifting block 5a or the lower shifting block 5b rotates in the clockwise direction, not only may the lower lock tongue support frame 4b and the lower hook tongue 2b be pushed to move towards the outer side, but also the upper lock tongue support frame 4a and the upper hook tongue 2a may be pushed to move towards the outer side, namely a relationship of relatively moving to be away from each other is formed between the pair of upper and lower hook tongues 2a, 2b, and conversely, when the upper shifting block 5a or the lower shifting block 5b rotates in the anticlockwise direction, a relationship of relatively moving to be close to each other is formed between the pair of upper and lower hook tongues 2a, 2b.

In order to stably locate the upper and lower hook tongues (2a, 2b) on different positions and realize the flexibility when shifting the upper shifting block 5a or the lower shifting block 5b, a buffer spring 5d capable of pressing against the interconnecting piece 5c is arranged between the interconnecting piece 5c and the front shell 1a. Thus, when the upper shifting block 5a or the lower shifting block 5b rotates to a right side in the clockwise direction, the interconnecting piece 5c also moves towards the right side, and the lower end of the buffer spring 5d is also deviated to the right side and applies a leftward abutment force against the interconnecting piece 5c.

In order to properly limit the rotation angle of the upper shifting block 5a or the lower shifting block 5b, a limiting shaft 5e is arranged between the upper shifting block 5a and the lower shifting block 5b. The limiting shaft 5e is fixedly connected between the left and right shells 1b, 1c.

The outer side defined in the embodiment means two end sides of the lock and conversely, the inner side. The hook tongues 2a, 2b may be locked by only moving towards the outer side in locking or unlocking movements of the hook tongues 2a, 2b when the hook ends of the hook tongues 2a, 2b face to the outer side, and conversely, the hook tongues may be locked by moving towards the inner side (close to the middle) when the hook ends of the hook tongues 2a, 2b face to the inner side. The latter solution is selected in a general embodiment, for example, the embodiment. The upper and the lower defined in the embodiment, for example, the upper hook tongue 2a or the lower hook tongue 2b is defined according to an up-and-down direction shown when a lock body is mounted on a movable door leaf. However, a mounting direction of the lock body is needed to be adaptively regulated and rotated according to an opening direction (opened towards the left side or right side) of the door leaf.

What is claimed is:

1. A lock capable of locking a movable door, comprising a lock shell and hook tongues capable of performing locking work on a door leaf, the hook tongues including hook tongue upper parts and hook tongue lower parts, and the hook tongue upper parts being hook-shaped, the lock shell including a front shell, and left and right shells located at two sides of the front shell, the front shell being provided with opening parts corresponding to the hook tongues so that the hook tongues located in the lock shell being capable of extending out of the opening parts, the lock further comprising:

lock tongue support frames, movably disposed in the lock shell, the lock tongue support frames being combined with first shaft pins, the hook tongue lower parts of the hook tongues having lower shaft holes being formed in the hook tongue lower parts of the hook tongues, the hook tongues rotatably sleeving the first shaft pins via the lower shaft holes;

lock tongue reset springs, each of which provided with two free ends, one of the free ends being combined with the lock tongue support frames, the other one of the free ends being combined with the hook tongues so that the hook tongues being capable of automatically resetting from a head-lowering state to a head-raising standing state under an elastic drive of the lock tongue reset springs, and conversely, the hook tongues being pressed to the head-lowering state from a head-raising state when being pressed by an external force;

left and right first guide grooves, symmetrically arranged on the left and right shells and corresponding to the first shaft pins, two ends of each of the first shaft pins respectively extending into the left and right first guide grooves, the first shaft pins driving the hook tongues to move to be unhooked or locked when the lock tongue support frames move to drive the first shaft pins to move along the left and right first guide grooves; and shifting blocks, rotatably arranged on the left and right shells, axial centers of the shifting blocks having center holes that allow shifting sheets to be inserted therein, the shifting blocks being provided with shifting handles, and the lock tongue support frames being capable of moving back and forth to respond to the rotation of the shifting handles on the shifting blocks when the shifting blocks rotate.

2. The lock according to claim 1, the lock further comprising locating parts arranged on the lock tongue support frames, the hook tongue lower parts being further having shoulder parts matched with the locating parts, and the locating parts being suitable for matching with the shoulder parts to limit the head-raising standing states of the hook tongues when the lock tongue reset springs drive the hook tongues to rotate to be reset to the head-raising state from the head-lowering state on the first shaft pins.

3. The lock according to claim 2, wherein the shoulder parts are shaped like slopes, the locating parts are provided with regulating screws, tops of the regulating screws are also provided with slopes fitted with the shoulder parts, the shoulder parts press against the regulating screws when the hook tongues are in the head-raising standing state, and the standing angles of the hook tongues may be correspondingly and slightly adjusted when the heights of the regulating screws are regulated.

4. The lock according to claim 1, wherein connecting rods are arranged between the shifting handles and the lock tongue support frames and are used for realizing response of the lock tongue support frames to the rotation of the shifting handles, tail ends of the connecting rods are rotatably connected to the shifting handles, head ends of the connecting rods are hinged with head ends of the lock tongue support frames by second shaft pins, left and right second guide grooves corresponding to the second shaft pins are respectively formed in the left and right shells, and two ends of the second shaft pins respectively extend into the left and right second guide grooves and are capable of moving along groove tracks limited by the second guide grooves.

5. The lock according to claim 4, wherein crank arms capable of converting directions and transition connecting pieces are further arranged between the shifting handles and the lock tongue support frames, the crank arms are rotatably arranged between the left and right shells, center pin shafts for locating the crank arms are fixedly arranged on the left and right shells, so that the crank arms are capable of rotating around the center pin shafts, and an end-to-end connection relationship is that the head ends of the lock tongue support frames are connected to the head ends of the connecting rods, the tail ends of the connecting rods are connected to head ends of the crank arms, tail ends of the crank aims are connected to head ends of the transition connecting pieces, and tail ends of the transition connecting pieces are connected to the shifting handles.

6. The lock according to claim 1, wherein the lock tongue reset springs sleeve the first shaft pins and are located in accommodating spaces below the hook tongues.

7. The lock according to claim 1, wherein the lock tongue support frames are shaped as frames and are provided with left and right frames and connecting blocks connected between the left and right frames, the hook tongues sleeve the first shaft pins via the lower shaft holes and are located between the left and right frames.

8. The lock according to claim 1, the lock further comprising left and right first inclined grooves symmetrically arranged on the left and right shells and smoothly linked at the tail ends of the left and right first guide grooves, the left and right first inclined grooves extending in a direction inclined to the front shell, the left and right first inclined grooves being suitable for not only guiding the lock tongue support frames to sink, but also guiding the hook tongues to synchronously sink into the lock shell when the first shaft pins being descended along the first inclined grooves, and conversely, the left and right first inclined grooves being suitable for guiding the hook tongues to extend out of the opening parts.

9. The lock according to claim 1, wherein side edges of the shifting blocks are further provided with limiting shafts located on the left and right shells, and the limiting shafts are matched with the shifting handles and are used for limiting the rotation angles of the shifting blocks.

10. The lock according to claim 1, the lock further comprising a pair of hook tongues arranged up and down and a pair of shifting blocks, hook ends of the pair of hook tongues facing to opposite directions, and the pair of hook tongues being capable of relatively moving to be close to or away from each other under drive of any one of the pair of shifting blocks.

* * * * *